US010682651B2

(12) United States Patent
Sutti

(10) Patent No.: US 10,682,651 B2
(45) Date of Patent: Jun. 16, 2020

(54) JAW CRUSHER AND CRUSHING PLANT

(71) Applicant: Metso Minerals, Inc., Helsinki (FI)

(72) Inventor: Risto Sutti, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 394 days.

(21) Appl. No.: 15/122,500

(22) PCT Filed: Mar. 10, 2015

(86) PCT No.: PCT/FI2015/050151
§ 371 (c)(1),
(2) Date: Aug. 30, 2016

(87) PCT Pub. No.: WO2015/140393
PCT Pub. Date: Sep. 24, 2015

(65) Prior Publication Data

US 2017/0065983 A1 Mar. 9, 2017

(30) Foreign Application Priority Data

Mar. 17, 2014 (FI) ..... 20145241

(51) Int. Cl.
*B02C 21/02* (2006.01)
*B02C 1/02* (2006.01)
(Continued)

(52) U.S. Cl.
CPC ..... *B02C 21/026* (2013.01); *B02C 1/02* (2013.01); *B02C 1/04* (2013.01); *B02C 1/043* (2013.01);
(Continued)

(58) Field of Classification Search
CPC .. B02C 1/02; B02C 1/04; B02C 1/043; B02C 1/046; B02C 1/06
(Continued)

(56) References Cited

U.S. PATENT DOCUMENTS 2,598,942 A 6/1952 Rumpel
3,425,639 A * 2/1969 Kueneman ..... B02C 1/04 241/148
2009/0114750 A1* 5/2009 Yamazaki ..... B02C 1/025 241/34

FOREIGN PATENT DOCUMENTS

CN 2754720 Y 2/2006
CN 201064720 5/2008
(Continued)

OTHER PUBLICATIONS

Office Action issued for Chinese Patent Application No. 201580014257.5 dated Feb. 24, 2018.
(Continued)

*Primary Examiner* — Shelley M Self
*Assistant Examiner* — Jared O Brown
(74) *Attorney, Agent, or Firm* — Andrus Intellectual Property Law, LLP

(57) ABSTRACT

A jaw crusher has frame side walls, a rear end connected to the side walls, an eccentric supported by the side walls, a pitman supported by the eccentric, a toggle plate connected between the pitman and a middle section of the rear end including a cross wall. The rear end has a rear end support connected to the cross wall and located on a center plane of the cross section of the rear end. An upper and lower rear cross beams are fixed to the side walls. The upper and lower rear cross beams each have a vertical wall and horizontal ribs connected to the vertical wall. A crushing plant is also disclosed with a body and the jaw crusher mounted on the body.

14 Claims, 3 Drawing Sheets

(51) Int. Cl.
*B02C 1/04* (2006.01)
*B02C 1/06* (2006.01)
*B02C 23/08* (2006.01)

(52) U.S. Cl.
CPC ..... *B02C 1/046* (2013.01); *B02C 1/06* (2013.01); *B02C 23/08* (2013.01)

(58) Field of Classification Search
USPC .... 241/198.1, 208, 214, 215, 217, 223, 231, 241/241.5, 264, 266, 268
See application file for complete search history.

(56) References Cited

FOREIGN PATENT DOCUMENTS

| | | | | |
|---|---|---|---|---|
| CN | 201912959 | U | 8/2011 | |
| CN | 204093491 | | 1/2015 | |
| FR | 2549392 | A2 * | 1/1985 | ..... B02C 1/02 |
| FR | 2683462 | A1 * | 5/1993 | ..... B02C 1/025 |
| KR | 101018767 | | 3/2011 | |
| WO | 2006072323 | | 7/2006 | |

OTHER PUBLICATIONS

International Search Report and Written Opinion for International Application No. PCT/FI2015/050151 dated Jun. 18, 2015.
International Preliminary Report on Patentability or International Application No. PCT/FI2015/050151 dated Jul. 1, 2016.
Search Report from Office Action for Finnish Application No. 20145241 dated Nov. 14, 2014.

* cited by examiner

JAW CRUSHER AND CRUSHING PLANT

CROSS-REFERENCE TO RELATED APPLICATIONS

This application claims priority to PCT/FI2015/050151 filed Mar. 10, 2015, and published in English on Sep. 24, 2015 as publication number WO2015/140393, which claims priority to FI Application No. 20145241, filed Mar. 17, 2014, the disclosures of which are incorporated herein by reference.

TECHNICAL FIELD

The invention relates to a jaw crusher and a crushing plant.

BACKGROUND ART

Mineral material, for example rock, is gained from the earth for processing by exploding or excavating. The mineral material can also be natural rock and gravel or construction waste such as concrete or bricks, or asphalt. Mobile crushers and stationary crushing applications are used in crushing. An excavator or wheeled loader loads the material to be crushed into the crusher's feed hopper from where the material to be crushed may fall in a crushing chamber of a crusher or a feeder moves the rock material towards the crusher.

Jaw crushers are suitable for example for coarse crushing at open pits or for crushing of construction waste. According to the function principle of the jaw crusher the crushing takes place between and against jaws, the so called fixed and movable jaws.

In a known jaw crusher a pitman is arranged movable relative to the frame of the crusher. An upper end of the pitman is supported by an eccentric to side walls of the frame of the jaw crusher. A rear end part of the frame is connected between the side walls. A lower end of the pitman is supported by a toggle plate to the rear end.

The toggle plate and a return rod are mounted between the lower end of the pitman and the rear end. The return rod is spring-tensioned and pulls the pitman backwards against the toggle plate and the toggle plate against the rear end. An example of a prior art jaw crusher with a rear end equipped with an adjusting apparatus for the toggle plate is shown in FIG. 1. Examples of known rear end cross sections are shown in FIGS. 2 and 3.

CN 201064720Y shows a jaw crusher having a frame with side walls which are connected to each other by a rear end part of the frame. A rear end of a toggle plate is supported by the rear end part. A wedge adjusting apparatus for the toggle plate is mounted between the toggle plate and the rear end part.

An object of the invention to provide new alternative technical alternatives by which drawbacks present in connection with prior art can be eliminated or at least reduced.

SUMMARY

According to a first example aspect of the invention there is provided a jaw crusher comprising frame side walls, a rear end connected to the side walls, an eccentric supported by the side walls, a pitman supported by the eccentric, a toggle plate connected between the pitman and a middle section of the rear end comprising a cross wall, and the rear end comprises a rear end support connected to the cross wall and located on a center plane of the cross section of the rear end.

The rear end support is formed as a beam which is integrated to the cross wall. The jaw crusher further comprises one or more return rods and integrated to the rear end, a return rod support beam or return rod supports, the return rod support beam or return rod supports comprising corresponding one or more return rod support openings.

Preferably the rear end support is configured to receive a crushing force transmitted by the toggle plate towards a first side of the cross wall directly on the opposite second side of the cross wall.

Preferably the rear end support is formed as a beam which is integrated to the cross wall.

Preferably the rear end support extends along the width of the rear end cross wall from the first side wall of the crusher to the second side wall.

Preferably the eccentric is arranged to move the pitman reciprocatively.

Preferably the rear end support has a cross section that equals substantially a rectangle having a length substantially in the longitudinal direction of the crusher and a thickness perpendicular to the length, wherein said length is larger than said thickness.

Preferably a ratio of the thickness to the length of the substantially rectangular cross section of the rear end support is 1:6, preferably between 1:6 and 1:2.

Preferably the crusher comprises one or more return rods and a return rod support beam is integrated to the rear end comprising one or more return rod support openings.

Preferably the return rod support beam extends from the first sidewall to the second sidewall of the crusher frame.

Preferably an upper rear cross beam and/or a lower rear cross beam is fixed to the side walls of the crusher, the upper rear cross beam and the lower rear cross beam comprising a substantially vertical wall and substantially horizontal ribs connected to said vertical wall, and the substantially horizontal ribs are directed away from the crusher.

According to a second example aspect of the invention there is provided a crushing plant comprising a body and a jaw crusher mounted on the body and comprising jaw crusher side walls, a rear end connected to the side walls, an eccentric supported by the side walls, a pitman supported by the eccentric, a toggle plate connected between the pitman and a middle section of the rear end comprising a cross wall, and the rear end comprises a rear end support connected to the cross wall and located on a center plane of the cross section of the rear end. The rear end support is formed as a beam or return rod supports integrated to the cross wall. The jaw the crusher further comprises one or more return rods and integrated to the rear end, the return rod support beam or return rod supports comprising one or more return rod support openings.

Preferably the processing plant is a movable processing plant comprising a feeder and/or a screen and/or a conveyor mounted on the body.

A technical advantage of different embodiments of the invention is increase of efficient operation time of the mineral material processing plant.

Mineral material processing can be implemented more economically because less strain energy goes to the crusher structures and more energy goes to breaking stones. This means more crushing productivity.

The new structure of the rear end reduces bending of the rear end, stress concentrations and residual stress in the rear end and thus provides more fatigue life for the rear end structure.

In some embodiments the new structure of the return rod support cross beam included in the rear end increases twisting rigidity of the entire crusher frame, thus leading to increased life of the crusher frame and particularly to increased life of dynamical parts of the crusher such as the main bearings of the eccentric.

The pressing work in a crushing event is better focused in breaking the stone and not in the transformation (elasticity) of the rear end or twisting of the frame. Thus the stone may be crushed with smaller stroke count and smaller stroke length. The capacity of the crusher and the crushing plant may be increased because the mineral material is crushed and does not stay waiting for a new stroke. Crushing work done by a smaller stroke also affects other components of the crusher which may be lightened or cheaper components can be selected for the crusher. If necessary, the mass of a flywheel and a counterweight may be reduced. The power source may be smaller in power, as well. The amount of the energy engaged in the flywheel may be reduced. The environment is less burdened because of savings in material and energy.

The quality of manufacturing the rear end can be improved. There are less work phases and the manufacturing may be speeded up. When casting no cores are needed which may cause differences in wall thickness (because of core improper placement) and additional costs. In manufacturing the rear end less material is needed which reduces the mass of the crusher frame. Weight may also be reduced by machining the edges of the rear end support because a machined surface has significantly higher fatigue strength than a casted surface. The casting is more easily done.

In the manufacturing a considerably better end quality can be achieved. The wall thickness of the rear end support can be easily checked. In opposite to the prior closed casted structures, the openness of the rear end structure makes it easy to check and fix casting defects and less residual stress is achieved in the new rear end structure. Casting defects can easily be removed by grinding from the rear edge of the rear end support which are critical in tension and peak stresses. Casting defects can similarly be removed from the rear edges of the backwards directed ribs of the upper and lower rear cross beams which are critical in tension and peak stresses. Large defects can be filled with metal after grinding and finally finished by grinding. Sand cleaning holes are not needed which means less stress concentrations at the holes and lengthening of the fatigue life of the new structure. The sand removal phase is left out.

Holes formed in the structure because of casting may be avoided by an open structure of the rear end. Thus strength-weakening stress peaks caused by crushing forces may be diminished in the structure. The fatigue strength of the rear end structure is enhanced because the deflection of the cross wall of the rear end is eliminated by the rear end support which is substantially aligned with the crushing force.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying schematical drawings, in which.

DETAILED DESCRIPTION

In the following description, like numbers denote like elements. It should be appreciated that the illustrated drawings are not entirely in scale, and that the drawings mainly serve the purpose of illustrating some example embodiments of the invention.

Figure 1:
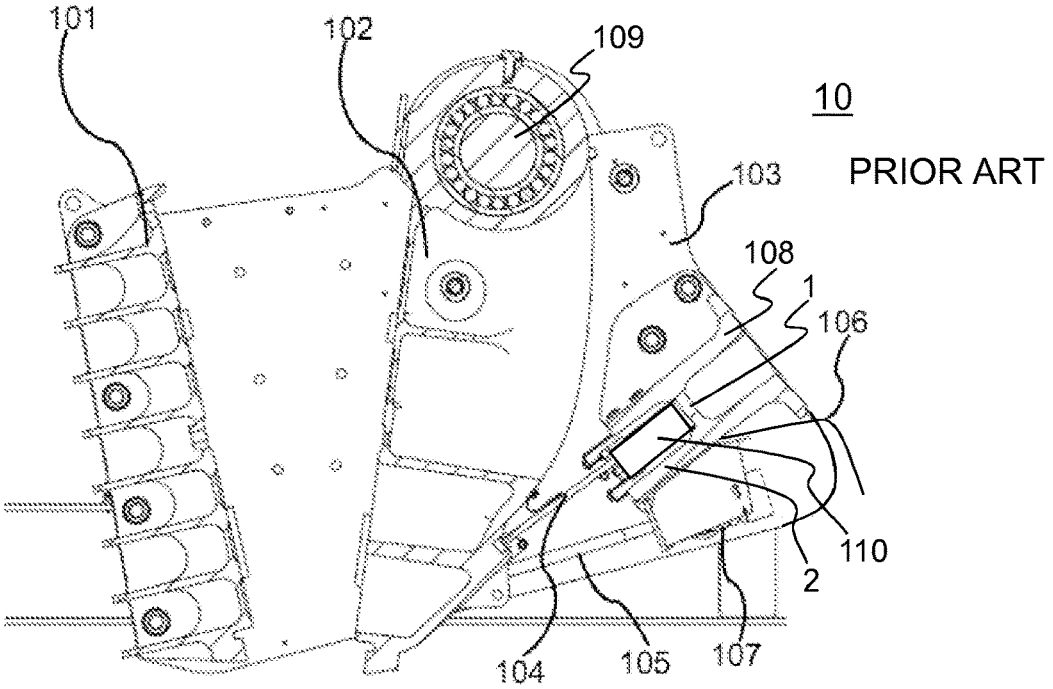
FIG. 1 shows a longitudinal cross section of a jaw crusher.

FIG. 1 shows a prior art jaw crusher 10 comprising a fixed jaw 101 as a front part of the jaw crusher. The jaw crusher 10 comprises a pitman 102 as a movable jaw of the jaw crusher. An upper end of the pitman is supported by an eccentric 109 to side walls 103 of the frame of the jaw crusher. A rear end 108 of the frame is connected between the side walls 103. A lower end of the pitman is supported by a toggle plate 104 to the rear end. A cross wall 1 of the rear end 108 receives a crushing force directed backwards through the toggle plate 104. The toggle plate and a return rod 105 are mounted between the lower end of the pitman and the rear end 108. The return rod is tensioned by a spring 107 and pulls the pitman backwards against the toggle plate and the toggle plate towards the rear end. An adjusting apparatus 110 for the toggle plate is mounted between the toggle plate 104 and the rear end cross wall 1. The adjusting apparatus 110 is located between first side walls 2 of the rear end. The jaw crusher comprises a protection cover 106 between the operator and the return rod spring.

Figure 2:
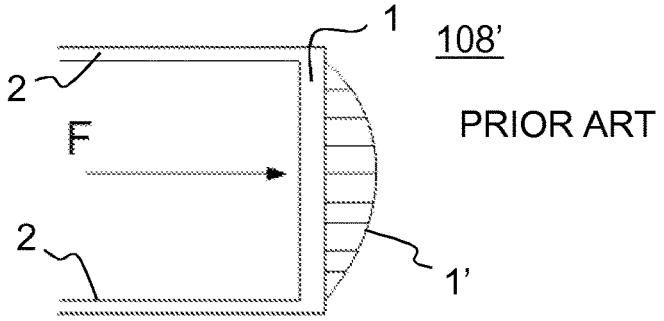
FIGS. 2 and 3 show cross sections of prior art rear ends.

FIG. 2 shows a cross section of a rear end 108' comprising a cross wall 1 and first side walls 2 extending from upper and lower ends of the cross wall 1. The first side walls are arranged substantially perpendicularly relative to the cross wall and forming a space therebetween for receiving the adjusting apparatus 110 for the toggle plate (for example a wedge adjusting apparatus) and the rear end of the toggle plate 104.

Figure 3:
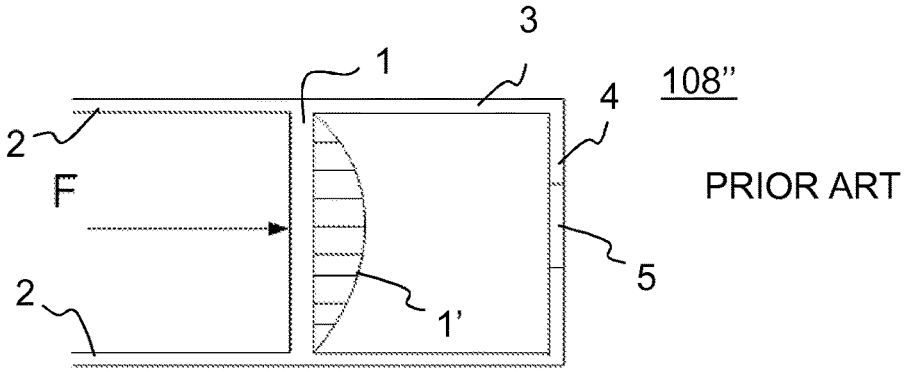

FIG. 3 shows a cross section of a rear end 108" which comprises second side walls 3 additionally to the rear end of FIG. 2. The second side walls 3 extend from the ends of the cross wall to the opposite direction relative to the first side walls 2, thus forming elongated side walls that are fixed to both ends of the cross wall 1 and substantially perpendicular to the cross wall. Additionally the second side walls 3 are connected to each other by a second cross wall 4. The cross wall 1, the second side walls 3 and the second cross wall 4 are forming a closed cross section. For the sake of production by casting, holes 5 (sand cleaning hole) are made to the second cross wall 4 (or to the second side walls 3, not shown in the figure) in order to empty a casting core from the closed cross section.

During operation of the crusher 10 the crushing force F is directed towards the cross wall 1 of the rear end 108, 108' and 108" (FIGS. 1, 2 and 3, respectively) through the toggle plate 104 and the adjusting apparatus 110. The force F bends the cross wall 1 between the first side walls 2 resulting in a deflection 1' of the cross wall. Additionally the rear end is bending backwards between the connecting points of the rear end to the side walls.

FIGS. 4 to 10 show rear ends 111 which can be used in substitution of the known rear end 108 in the crusher shown in FIG. 1, thus forming a new and inventive crusher.

Figure 4:
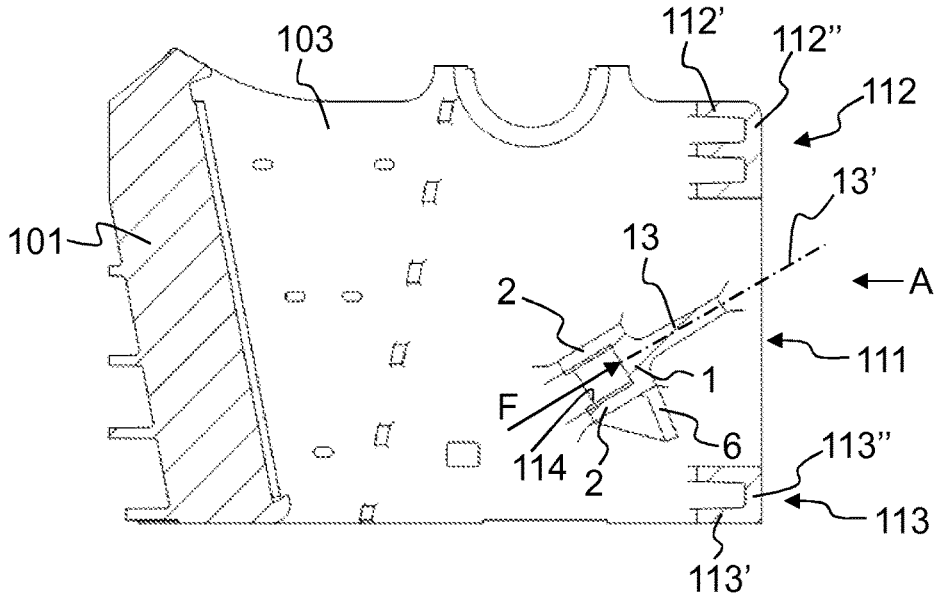
FIG. 4 shows a cross section of an embodiment of a rear end according to the invention connected to a side wall of a jaw crusher.
Figure 8:
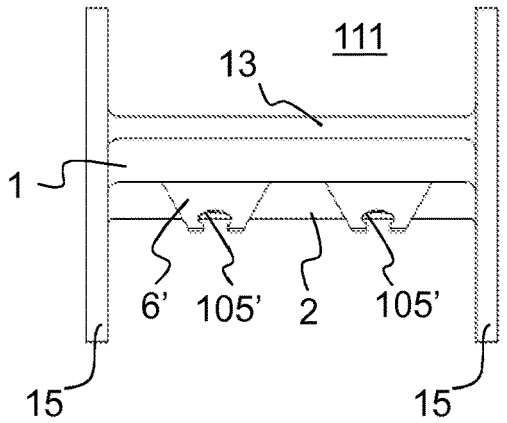
FIG. 8 shows the rear end of FIG. 7 comprising additionally side connecting flanges.
Figure 9:
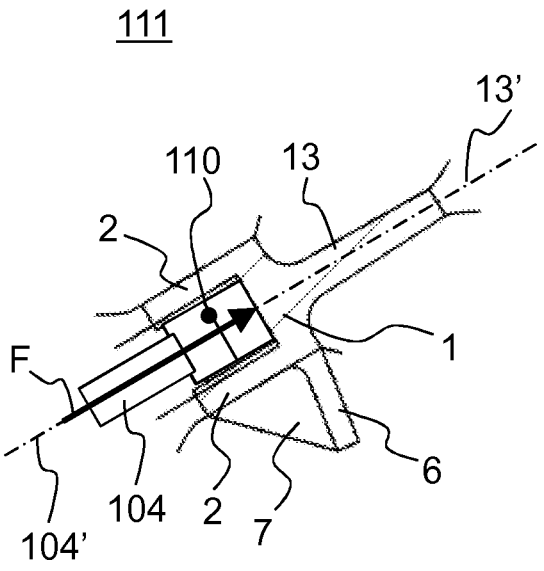
FIG. 9 shows the rear end of FIG. 4.

FIGS. 4 and 9 shows a cross section of a rear end 111 connected to a side wall 103 of a jaw crusher. The rear end 111 can be integrated by casting or by welding to the side walls as well as the front wall 101 and, optionally an upper rear cross beam 112 and/or a lower rear cross beam 113. The rear end 111 may alternatively be formed as a separate part as described with reference to FIGS. 6, 8 and 10, and bolted to the side walls 103. The side walls 103 comprise an opening 114 for operating a toggle plate adjusting apparatus 110 from outside the crusher frame.

In FIG. 4 the upper rear cross beam 112 has a cross section in which substantially horizontal ribs 112' are connected to a substantially vertical wall 112", and the lower rear cross beam 113 is formed similarly wherein the number of ribs may be selected from 2 to 5 ribs. In the example embodiment FIG. 4 the ribs 112', 113' are directed inside the crusher. Alternatively or optionally the ribs 112' of the upper rear cross beam 112 and/or the ribs 113' of the lower rear cross beam 113 can be directed away from the crusher, in other words the ribs can be directed substantially backwards. The ribs may have an inclination relative to the horizontal plane of ±10° in the longitudinal direction of the crusher.

The rear end 111 comprises a cross wall 1 (forming a middle section of the cross section), and first side walls 2 (forming a front section of the cross section) extending forwards in the direction of an arrow A from upper and lower ends of the cross wall 1. The first side walls are substantially perpendicular to the cross wall and forming a space therebetween for receiving the adjusting apparatus 110 for the toggle plate (for example a wedge adjusting apparatus 110) and the rear end of the toggle plate 104. The rear end 111 comprises a rear end support 13 (forming an end section of the cross section) extending backwards from the cross wall 1 to opposite direction relative to the receiving point of the toggle plate 104 and/or the adjusting apparatus 110 between the first side walls 2 and the receiving point of the crushing force F transmitted by the toggle plate.

The rear end support 13 is located on a center plane 13' of the cross section of the rear end. The center plane 104' of the toggle plate 104 moves in a typical crushing operation on both sides of the center plane 13' of the rear end during one crushing cycle, e.g. one revolution of the eccentric 109. During one crushing cycle the center plane 104' of the toggle plate 104 is normally twice (may also be one time) parallel with the center plane 13' of the rear end 13. The angle of movement of the center plane 104' of the toggle plate 104 depends on the crushing application and the setting of the crusher, and the angle is the larger the smaller is the setting wherein the crushing force is the larger the smaller is the setting. Typically, in a center position of the angle of movement of the toggle plate the center plane 13' of the rear end 13 is directed substantially in the direction of the center plane 104' of the toggle plate 104 and thus in the direction of the crushing force F transmitted by the toggle plate. Preferably the front most point of the rear end support 13 is fixed to the cross wall 1 substantially centrally between the upper and lower ends of the cross wall.

The crushing force F directed towards the cross wall 1 on the center plane 13' does not bend the cross wall 1 backwards between the first side walls 2 as described in connection with the prior art rear ends 108, 108', 108" because the rear end support 13 located on the force affecting route minimizes or prevents any deflection of the cross wall. Thus less strain energy is used than in connection with jaw crushers equipped with prior art rear ends.

The rear end support 13 is formed as a beam which is integrated to the rear end, preferably during manufacturing by casting. The rear end support extends from a first side wall 103 to a second side wall 103 of the crusher frame.

The rear end 111 preferably also comprises a return rod support 6 integrated to the rear end 111. The rear end 111 may support one, two, or more return rods 105. Regarding the illustrations of FIGS. 5 to 8 the crusher comprises two return rods and the rear end 111 comprises a corresponding number of support openings 105' for the return rods 105. In FIGS. 5 to 8 the rear ends are depicted in a direction of an arrow A of FIG. 4.

Figure 5:
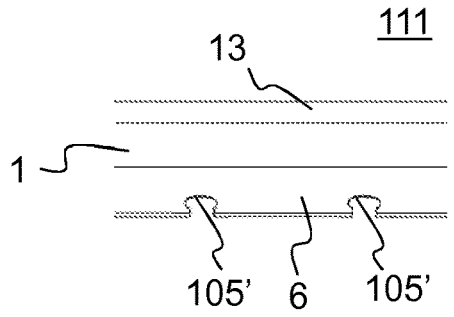
FIG. 5 shows a first example embodiment of a rear end.
Figure 6:
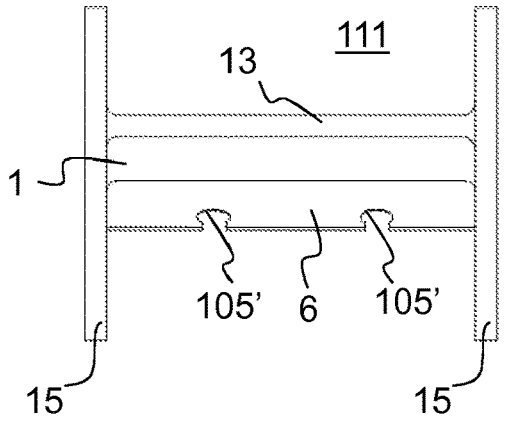
FIG. 6 shows the rear end of FIG. 5 comprising additionally side connecting flanges.

FIG. 5 shows a rear end 111 with a return rod support beam 6, integrated to the rear end and two return rod support openings 105' formed to the beam. Preferably the return rod support beam 6 extends from the first sidewall to the second sidewall of the crusher frame. Preferably the return rod support beam 6 is integrated to the middle section of the rear end. Preferably the return rod support beam 6 is located substantially vertically. The return rod support beam 6 increases rigidity and stiffness of the entire crusher frame and minimizes twisting of the crusher frame. FIG. 6 shows the rear end of FIG. 5 comprising additionally side connecting flanges 15 that can be bolted to the side walls 103.

Figure 7:
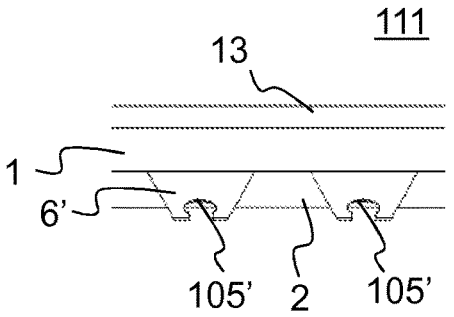
FIG. 7 shows a second example embodiment of a rear end.

FIG. 7 shows a rear end 111 with two return rod supports 6' arranged separately from each other, integrated to the rear end and located at a distance from each other, without any direct connection to the side walls 103 of the crusher. FIG. 8 shows the rear end of FIG. 7 comprising additionally side connecting flanges 15 that can be bolted to the side walls 103.

FIG. 9 shows the rear end 111 of FIG. 4 illustrated with a wedge adjusting apparatus 110 and a rear end of the toggle plate 104 between the first side walls 2 of the front section of the rear end. The return rod support 6 is connected to the lower first side wall 2 by one or more optional vertical support walls 7.

Figure 10:
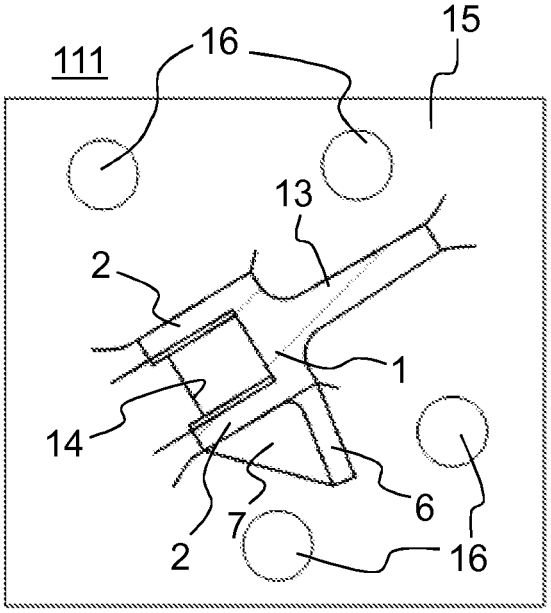
FIG. 10 shows a rear end comprising side connecting flanges.

FIG. 10 shows a rear end having a similar cross section to the rear end in FIG. 9 but comprising side connecting flanges 15 as shown in FIGS. 6 and 8. The side connecting flanges 15 comprise fixing holes 16 for connecting members such as bolts or pins. The side connecting flanges 15 comprise also an opening 14 for the adjusting apparatus 110 described above.

According to an example the width of the crushing chamber between the fixed jaw 101 and the pitman 102 is about 1600 mm and the thickness of the side walls 103 is about 70 mm. The crushing force transmitted by the toggle plate 104 is about 10 000 kN. Thus the force is very high. The length of the rear end side wall 2 is about 450 mm, the length of the rear end support 13 is 550 mm, the thickness of the of the rear end support 13 is substantially about 110 mm and the dimension of the cross wall perpendicular to the length of the rear end support is about 450 mm.

Figure 11:
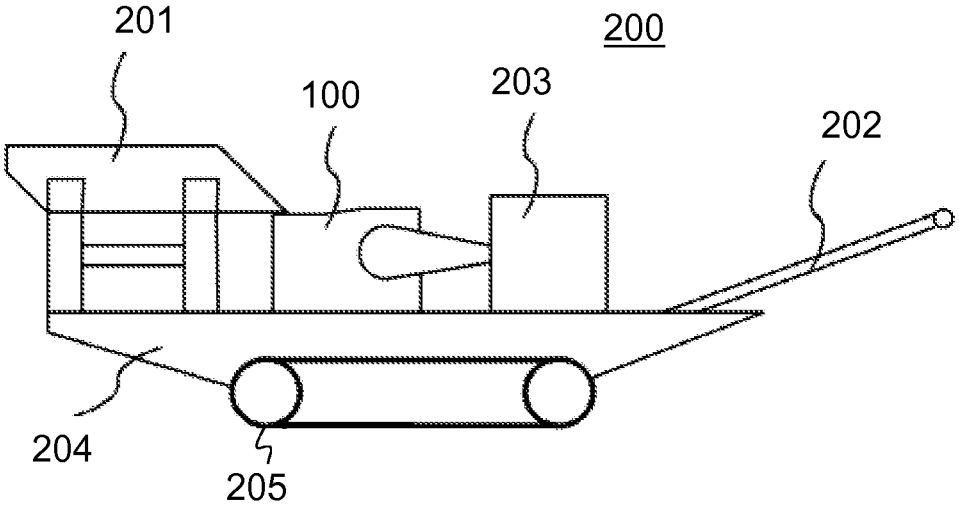
FIG. 11 shows a crushing plant comprising a jaw crusher according to the invention.

FIG. 11 shows a movable crushing plant 200 comprising a jaw crusher 100. In the crushing plant 200, there is a feeder 201 for feeding material into the jaw crusher 100 and a conveyor 202 for transferring crushed material further from the crushing plant. The crushing plant comprises one or more conveyors to convey material from a feeding end to a discharge end.

The crushing plant 200 preferably also comprises a power source and a control centre 203. The power source may be for instance a diesel or electric motor, which provides energy to be used by process units and hydraulic circuits.

The feeder 201, the crusher 100, the power source 203 and the conveyor 202 are attached to the body 204 of the crushing plant, which in this embodiment also comprises a track platform 205 for moving the crushing plant 200. The crushing plant may also be totally or partly wheel-based or movable by legs. Alternatively, it may be movable/towable for instance with help of a truck or some other exterior power source.

Mineral material may be for instance quarried stone or it may be asphalt or decommissioning waste such as concrete, or brick etc. In addition to the foregoing, the crushing plant may be a fixed crushing plant.

Embodiments of the jaw crusher 100 comprising a rear end 111 presented with help of any of FIGS. 4 to 10 may be used for instance in the crushing station 200. The crushing station 200 can be lighter than previously, when an increase in strength caused by the strengthening of the crusher frame is taken into account. The power used by the crusher per the amount of crushed mineral material may be smaller than with known applications because in the crushing event less energy is used as strain energy in the new rear end support and also twisting of the crusher frame may be reduced according to some embodiments. On the other hand, a greater crushing volume may be achieved with the same crushing power because a greater part of drive power may be focused in crushing mineral material.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of principles of the invention, and not in limitation thereof. Hence, the scope of the invention is only restricted by the appended claims.

The invention claimed is:

1. A jaw crusher comprising:
frame side walls;
a rear end connected to the frame side walls;
an eccentric supported by the frame side walls;
a pitman supported by the eccentric;
a toggle plate connected between the pitman and a first section of the rear end, the first section including a cross wall of the rear end, the toggle plate comprising a rear edge;
the rear end consisting of the first section and a second section, the first section defining a space for receiving the rear edge of the toggle plate;
wherein the second section of the rear end consists of a rear portion of the rear end that resides behind a rear surface of the cross wall,
wherein the rear portion consists of a single rear end support connected to the cross wall and located on and extending along a center plane of the cross section of the rear end for minimizing deflection of the cross wall, the single rear end support being formed as a single beam which is integrated to the cross wall and extends perpendicular to the cross wall, wherein the single beam is located on and extends along the center plane.

2. The crusher according to claim 1, wherein the rear end support is configured to receive a crushing force transmitted by the toggle plate towards a first side of the cross wall directly on a second side opposite of the first side of the cross wall.

3. The crusher according to claim 1, wherein the rear end support extends along the width of the rear end cross wall from a first side wall of the frame side walls to a second side wall of the frame side walls.

4. The crusher according to claim 1, wherein the eccentric is arranged to move the pitman reciprocatively.

5. The crusher according to claim 1, wherein the rear end support has a rectangular cross section that equals substantially a rectangle having a length substantially in the longitudinal direction of the crusher and a thickness perpendicular to the length, wherein said length is larger than said thickness.

6. The crusher according to claim 5, wherein a ratio of the thickness to the length of the rectangular cross section of the rear end support is between 1:6 and 1:2.

7. The crusher according to claim 5, wherein a ratio of the thickness to the length of the rectangular cross section of the rear end support is 1:6.

8. The crusher according to claim 1, wherein:
the crusher comprises one or more return rods and a return rod support beam including one or more return rod support openings,
the return rod support beam is integrated to the rear end, and
the return rod support beam extends from a first sidewall of the frame side walls to a second sidewall of the frame side walls.

9. The crusher according to claim 1, wherein:
the crusher comprises one or more return rods and return rod supports including one or more return rod support openings, and
the one or more return rod supports being integrated to the rear end.

10. The jaw crusher of claim 1, further comprising:
an upper rear cross beam fixed to the side walls, the upper rear cross beam comprising a vertical wall and horizontal ribs connected to said vertical wall; and
a lower rear cross beam fixed to the frame side walls, the lower rear cross beam comprising a second vertical wall and second horizontal ribs connected to said second vertical wall.

11. The crusher according to claim 10, wherein the horizontal ribs of the upper and lower cross beams are directed away from the crusher.

12. A crushing plant comprising:
a body;
a jaw crusher, wherein the jaw crusher is mounted on the body and the jaw crusher comprises:
jaw crusher side walls;
a rear end connected to the jaw crusher side walls;
an eccentric supported by the jaw crusher side walls;
a pitman supported by the eccentric;
a toggle plate connected between the pitman and a first section of the rear end comprising a cross wall,
wherein the toggle plate includes a rear edge, the rear end consists of the first section and a second section, the first section defines a space for receiving the rear edge of the toggle plate,
wherein the second section consists of a rear portion of the rear end that resides behind a rear surface of the cross wall and the end portion consists of a single rear end support connected to the cross wall and located on and extending along a center plane of the cross section of the rear end for minimizing deflection of the cross wall; and the single rear end support is formed as a single beam integrated to the cross wall and extending perpendicular to the cross wall, wherein the single beam is located on and extending along the center plane.

13. The crushing plant according to claim 12, wherein the crushing plant is a movable processing plant comprising a feeder, a screen, and a conveyor mounted on the body.

14. The crushing plant according to claim 12, wherein the rear end support is configured to receive a crushing force transmitted by the toggle plate towards a first side of the cross wall directly opposite a second side of the cross wall.

* * * * *